United States Patent [19]

Sypal

[11] Patent Number: 4,779,875

[45] Date of Patent: Oct. 25, 1988

[54] GAME BOARD

[76] Inventor: Bohumil Sypal, 48 Highview Crescent, Toronto, Ontario, Canada, M6H 2Y2

[21] Appl. No.: 160,992

[22] Filed: Feb. 26, 1988

Related U.S. Application Data

[63] Continuation of Ser. No. 843,207, Mar. 24, 1986, abandoned, which is a continuation-in-part of Ser. No. 774,529, Sep. 10, 1985, abandoned.

[51] Int. Cl.[4] ..... A63F 3/00

[52] U.S. Cl. ..... 273/253; 273/254; 273/255; 273/261

[58] Field of Search ..... 273/253, 255, 260, 261, 273/262, 248, 242, 243, 249, 254, 285

[56] References Cited

U.S. PATENT DOCUMENTS

| | | | |
|---|---|---|---|
| 1,353,764 | 9/1920 | Lambert | 273/248 |
| 2,557,583 | 6/1951 | Vitale | 273/255 X |
| 2,743,107 | 4/1956 | Hollossy | 273/248 |
| 3,155,391 | 11/1964 | Chittenden | 273/239 X |
| 3,833,221 | 9/1974 | Van Tol | 273/243 |
| 3,844,563 | 10/1974 | Isaac | 273/284 X |
| 4,029,320 | 6/1977 | Hausman | 273/288 X |
| 4,124,213 | 11/1978 | Kaplowitz | 273/248 |
| 4,211,419 | 7/1980 | Larsen | 273/248 |
| 4,262,907 | 4/1981 | Ginsberg et al. | 273/243 X |
| 4,273,337 | 6/1981 | Carrera et al. | 273/243 |

FOREIGN PATENT DOCUMENTS

| | | | |
|---|---|---|---|
| 1044268 | 12/1978 | Canada . | |
| 1164205 | 3/1984 | Canada . | |
| 433081 | 9/1967 | Switzerland | 273/260 |
| 258839 | 12/1926 | United Kingdom | 273/243 |
| 2147509 | 5/1985 | United Kingdom | 273/242 |

*Primary Examiner*—William H. Grieb
*Attorney, Agent, or Firm*—Burke-Robertson

[57] ABSTRACT

A game board apparatus for two or more players, having a control token movement area of adjacent vertically and horizontally aligned rows of rectangular spaces, with a plurality of spaced groupings of spaces forming pairings of token start and token finish areas. A plurality of distinctive game tokens are provided, representing individual players, for movement between the pairs of start and finish areas through the central token area. The game is played using a die, numbered cards or a spinner to determine the distance of movement of a player's tokens for each player's turn, game reward units associated with predetermined spaces on the central token movement area of the board and chance taking apparatus for determining the movement of tokens of the players or the disposition of game reward units. This basic game format permits a multitude of different themes and game variations.

16 Claims, 4 Drawing Sheets

GAME BOARD

This application is a continuation of my co-pending application Ser. No. 843,207 filed Mar. 24, 1986, which application in turn was a continuation-in-part of application Ser. No. 774,529 filed Sept. 10, 1985, and both now abandoned.

This application relates to a board game apparatus and more particularly to a game for two or more players which employs chance, skill, education and creation.

BACKGROUND OF THE INVENTION

Board games combining chance and skill are well-known and numerous. Many involve the use of dice and/or cards to move tokens from a start to a finish point on a board through a series of adjacent spaces, which may be peripherally positioned about the edges of the board or otherwise arranged on the game board. Examples of such prior art board games include those described and illustrated in Canadian Pat. No. 1,044,268 issued Dec. 12, 1978 of Magiera and Canadian Pat. No. 1,164,205 issued Mar. 27, 1984 of Sisak. Neither of these prior patents remotely contemplates the apparatus of the present invention.

It is an object of the present invention to provide a game of chance, skill, education and creation which will provide fun as well as challenge for players of all ages. It is a further object of the present invention to provide a basic game format which may be readily modified for different themes or to provide an entirely new game(s).

SUMMARY OF THE INVENTION

According to the present invention there is provided a game board apparatus comprising a game board which has a central token movement area of adjacent vertically and horizontally aligned rows of rectangular spaces, these spaces being laid out for random movement of tokens diagonally, vertically or horizontally between adjacent spaces. A plurality of spaced grouping of spaces associated therewith form pairings of spaced token start and token finish areas. The token start areas are located on the periphery of the central token movement area. A plurality of game tokens are provided, individual players having similar tokens which differ from those of other players. The game tokens are moved during play between pairs of start and finish areas through the central token movement area. A random numerical selection apparatus determines the distance of movement of a player's tokens on the board for each player's turn during play. Also provided are game reward units which are associated with predetermined spaces in the central token movement area. A chance taking apparatus is associated with predetermined other spaces in the central token movement area of the board. The chance taking apparatus determines movement of the tokens of the players or disposition of game reward units.

The random numerical selection apparatus may be, for example, die, cards bearing numerical indications, or a spinner having a pointer which is rotatable over a disc having segments numerically marked, to randomly point to one of such segments when rotated by a player. The chance taking apparatus may be cards with appropriate directions marked thereon. When cards are used for either numerical selection or chance taking, questions may be associated with these cards, the correct answer to which question must be given by a player drawing such a card to enable use of that card.

The collection of game reward units by the players provides a central element of motivation to the game which, besides adding to the interest created thereby, facilitates adaptation of the game to a variety of themes, as will be described in more detail hereinafter.

BRIEF DESCRIPTION OF THE DRAWINGS

These and other objects and advantages of the invention will become apparent upon reading the following detailed description and upon referring to the drawings in which.

Figure 1A:
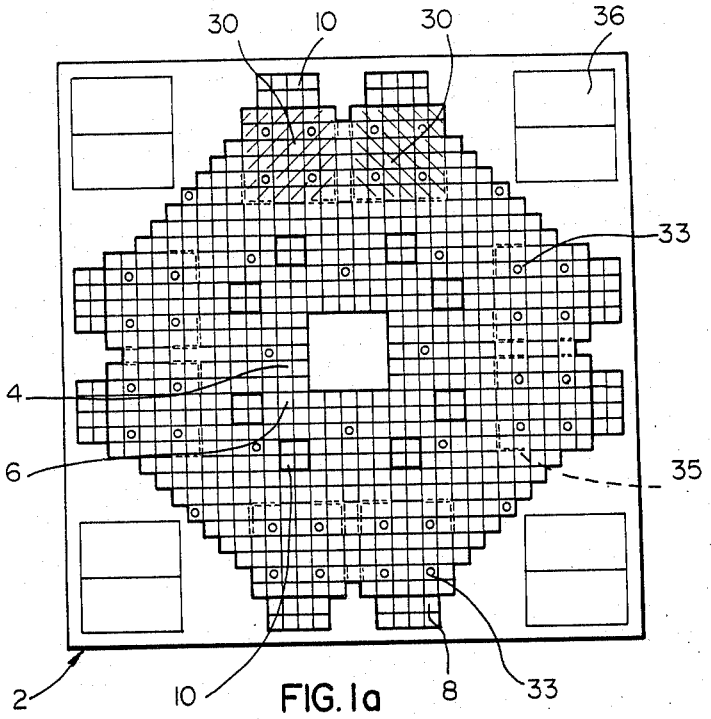
FIGS. 1*a*, 1*b*, 1*c* and 1*d* are plan views of alternative board formats for use in the apparatus according to the present invention.
Figure 1B:
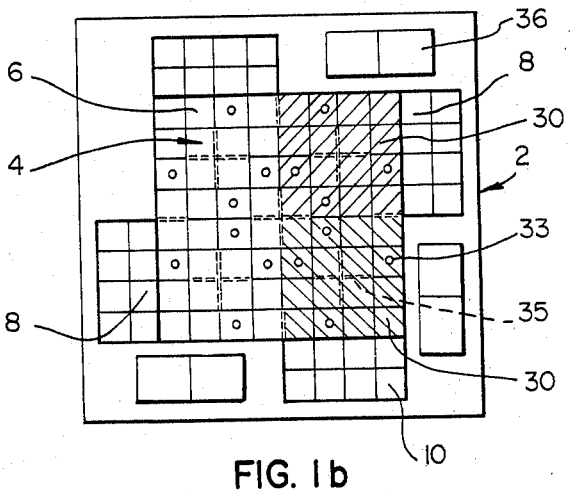
Figure 1C:
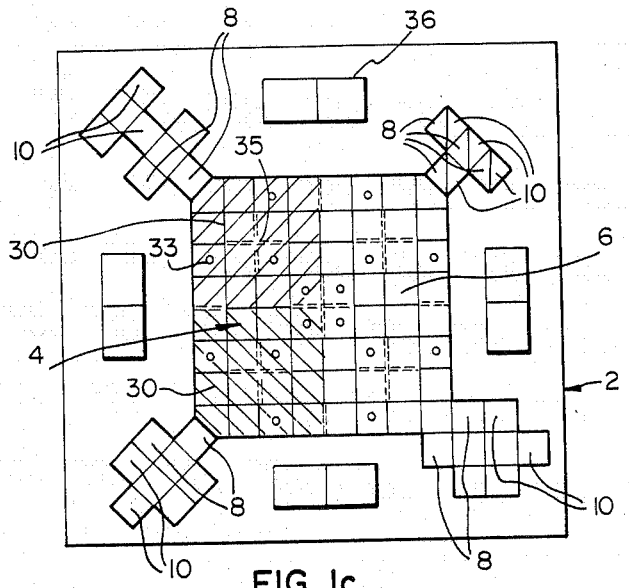
Figure 1D:
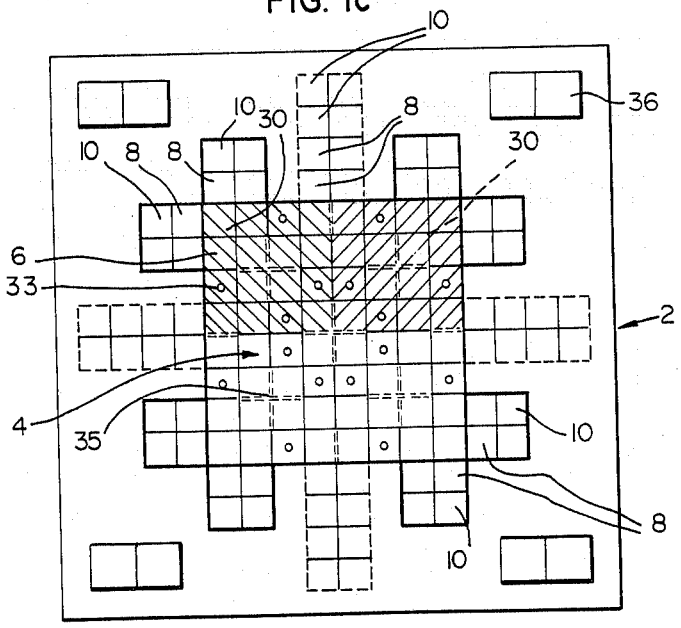

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to the drawings, as can be seen in FIGS. 1*a*, 1*b*, 1*c* and 1*d*, the game board 2 according to the present invention may have a wide number of various and distinctive layouts. Each however has a central token movement area 4 (which could have various numbers, as designed), made up of adjacent vertically and horizontally aligned rows of rectangular spaces 6. Additionally, a plurality of groupings of spaces 8 are provided on the periphery of the central token movement area 4 as token start areas, and groupings of spaces 10, either on the periphery of central token movement area 4 or somewhere within as token finish areas. Token start spaces 8 and token finish spaces 10 are paired, so that tokens starting from a particular group of spaces 8 must finish at a predetermined related grouping of token finish spaces 10. The token start spaces 8 and the token finish spaces 10 on the periphery may be reversed, if desired.

Figure 4:
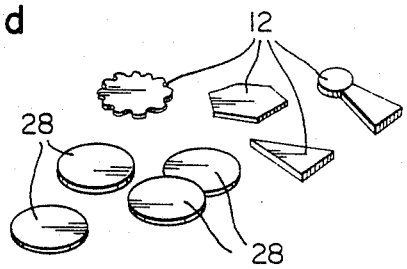
FIG. 4 is a schematic view illustrating tokens and game rewards units for use in accordance with the present invention.

A plurality of game tokens 12, representing individual players, are provided, as illustrated in FIG. 4, for movement in the spaces 6 between corresponding pairs of groups of start and finish spaces 8 and 10, through the central token movement area 4. Each player will have a plurality of similar, distinctive tokens 12, differing from those of the other players, to be used in the playing of the game. It will of course be understood that one of aims of the game is for each player to manoeuvre his or her pawns across the board, from that player's token start spaces 8, to that player's corresponding token finish spaces 10.

Figure 2A:
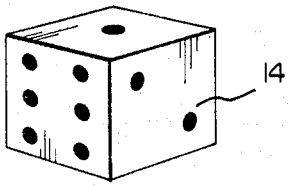
FIGS. 2*a*, 2*b*, 2*c* and 2*d* are respectively perspective (FIG. 2*a*) and plan (FIGS. 2*b*, 2*c* and 2*d*) views of alternative forms of random numerical selection apparatus for determining the distance of movement of a player's tokens on the board during play, in accordance with the present invention.
Figure 2B:
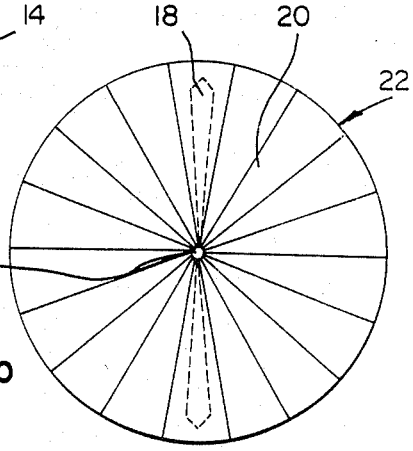
Figure 2C:
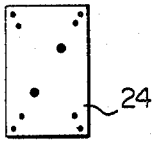
Figure 2D:
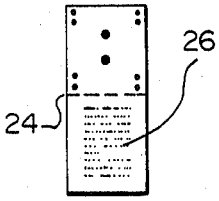

To determine the distance of movement of a player's tokens 12 on board 2, for each player's turn during playing of the game, random numerical selection apparatus such as a die 14 (FIG. 2*a*), a spinner 16 having a pointer 18 which, when spun, randomly points to one of the number-bearing segments 20 on base 22 on which pointer 18 is supported (FIG. 2*b*), or a deck containing variously numbered cards 24 (FIGS. 2*c* and 2*d*) may be alternatively used. Numbered cards 24 may bear simple numerical references (FIG. 2*c*) or, as illustrated in FIG. 2*d*, may additionally be provided with a question for the player to answer in space 26 (a question not being illustrated in the drawing). In this case, of course, the answer to the question is provided with the board apparatus, in an appropriate conventional fashion, and failure of the player to answer the question would prevent use of that card for that player's turn.

The game apparatus is also provided with game reward units 28 (FIG. 4), which units are associated in a conventional way, for example by colour coding, with predetermined spaces 30 on the central token movement area 4 of the board. These spaces 30 may be of any shape, in any location and as many in numbers as required or desired regardless of the shape of the playing board. These spaces 30 could take up part of or a full area of the gameboard (size of area(s) as desired) and could provide different designs or checkerboard pattern, as desired. It is preferred that a plurality of units 30 be similarly coded (by colour or otherwise) and have corresponding game reward units. By devising the rules of play of the game so that a player must direct his tokens through a predetermined number of differently coded spaces 30, thereby collecting corresponding game reward units associated with these spaces, in moving the tokens from start spaces 8 to finish spaces 10, an added dimension of the game is created. This aspect of the game lends itself readily to different themes for the game, such as, for example:

(a) Medieval Era: Each grouping of coloured spaces 30 could represent a castle defended by a knight. The token 12 could then represent a team of warriors dispatched by the Emperor to bring a hostage (colored or specially coded game reward unit 28) from each castle.

(b) Early Canadian/American Era: Each coloured or coded grouping of spaces 30 could represent an Indian tribe. The tokens 12 could then represent emissaries (courreurs-de-bois) sent to visit each tribal chief and return with a signed Peace Treaty (coloured or specially coded game reward unit 28).

(c) Space Theme: Each coloured or coded groupings of spaces 30 could represent a star in a galaxy. The tokens 12 could then represent a fleet of spaceships dispatched to bring back a rare precious mineral (coloured or specially marked game reward unit 28) found only on that particular star.

Figure 3A:
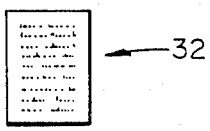
FIGS. 3*a* and 3*b* are plan, schematic views of alternative forms of chance taking cards for use in the apparatus according to the present invention.
Figure 3B:
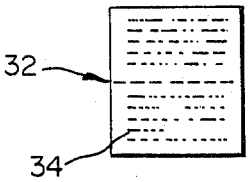

To further enhance particularly the chance taking aspect of the game, chance taking apparatus, preferably in the form of cards 32 (FIGS. 3*a* and 3*b*) associated with predetermined spaces 33 in the central token movement area 4 (preferably different from spaces 30) are provided for determining movement of the tokens 12 of the players or disposition of game reward units 28. These cards 32 might simply have directions for example concerning movement of tokens of the player drawing the card or those of the other players, or obtaining or loss of game reward units (FIG. 3*a*) or, additionally, have a question the answer to which the player drawing the card must give correctly in order to be able to use the card, the question being placed in a portion 34 of the card (FIG. 3*b*).

On such chance taking cards 32, instructions such as the following might be used:

(1) "Keep—You may move any of your tokens to any unoccupied space (33) coded with the colour (as desired), and draw one "chance taking" card."

(2) "Use Now—Take an additional turn."

(3) "Keep—Keep this card until you have acquired all coloured or specially coded, marked and/or designed game reward units 28 and then use it to move any of your tokens to your finish spaces (10)."

(4) "Use Now—This card entitles you to move any of your tokens any number of spaces up to and including 3. Move in a straight line only (i.e. horizontally, vertically or diagonally across)."

(5) "Keep—You may move any of your tokens to any unoccupied space (33) anywhere in the token movement area 4 and collect 1 (more) game reward unit (28)."

(6) "Use Now—Return any of your tokens to one of your start spaces (8)."

(7) "Use Now—Give one of your game reward units (28) to each of your opponents."

Turning to FIG. 1*a*, for example, spaces 33 might be coded with a symbol (e.g. "O") as illustrated. Obstacles to impede direct movement of tokens in central area 4 may be provided by a particular indication such as shown by reference numeral 35, which impediments may be of any form and/or shape and in any location of the central token movement area 4.

Appropriate spaces for chance taking cards or random numerical selection cards, if used, may be provided as illustrated at 36 (FIG. 1*a*).

In the standard form of playing the game according to the present invention, both random numerical selection cards and chance taking cards are used. The players may have their own coloured or specially coded, marked and/or designed tokens to be placed on each player's own token start spaces 8. Each player in turn would draw a random numerical selection card 24 to determine the movement of that player's token 12. If a token falls on a chance taking space 33, then that player would draw a chance taking card 32 and move his and/or his opponent's tokens or receive or give up game reward units as called for on the card. If the numerical selection cards and chance taking cards are the type provided with questions 26, 34, then the player would be expected to answer the question correctly or forfeit the use of such card. The passage of a player's token through a space 30 would entitle that player to a correspondingly coded game reward unit 28. Of course, any number of variations on these basic rules could be effected on this basic game board apparatus and any appropriate manner of selecting the winner of the game could be set-up.

The movement of the player's token(s) may be made in a straight line going forwards, backwards, horizontally, vertically or diagonally across the game board as a player desires and/or as the rules require.

Figure 5:
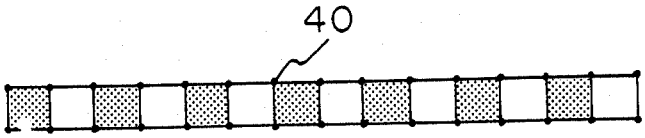
FIGS. 5, 5*a*, 6 and 7 are respectively plan views of detachable specially designated spaces and obstacles which may be used to modify the game board as required by the players.
Figure 5A:
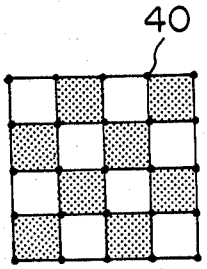
Figure 6:
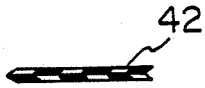
Figure 7:
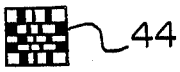

In one adaptation of the game in accordance with the present invention, as illustrated in FIGS. 5 and 5*a*, reusable space elements 40 may be provided which are releasably securable to the board so that the players may change the game board as they wish, prior to commencement of play. Space elements 40 may be made of magnetic material or have a magnetic backing where the board is made of an appropriate magnet-attractive material. Alternatively, they may have a backing of reusable self-adhesive or be securable in any other appropriate manner. These space elements 40 are, for example, intended to take the place of or be in addition to spaces 30 (FIGS. 1*a* to 1*d*) permanently positioned on the board. As well, obstacle means 42 illustrated in FIG. 6, and reward/bonus spaces 44 illustrated in FIG. 7, which are similarly releasably securable to the board, may be provided to change the game board as desired by the players, taking the place of or, in addition to, the permanently positioned obstacle means 35 of FIGS. 1*a* to 1*d* and the permanently positioned reward/bonus spaces 33 in FIGS. 1*a* to 1*d*, respectively. Again obstacle means 42 and reward/bonus spaces 44 may be secured to the board by appropriate magnetic or adhesive means, or in any other appropriate fashion.

Thus it is apparent that there has been provided in accordance with the invention a game board apparatus that fully satisfies the objects, aims and advantages set forth above. While the invention has been described in conjunction with specific embodiments thereof, it is evident that many alternatives, modifications and variations will be apparent to one skilled in the art in light of the foregoing description. For example, the game is readily adaptable to a software/computer format. Accordingly, it is intended to embrace all such alternatives, modifications and variations as fall within the spirit and broad scope of the invention.

What I claim as my invention:

1. A game board apparatus comprising in combination:

(a) a game board having a central token movement area of adjacent vertically and horizontally aligned rows of rectangular spaces, the spaces laid out for random movement of token diagonally, vertically or horizontally between adjacent spaces, with a plurality of spaced groupings of spaces forming pairings of token start and token finish areas, the token start or the token finish areas being located on the periphery of the central token movement area;

(b) a plurality of similar game tokens, distinctive for individual players, each token for movement diagonally, vertically or horizontally as selected by the player in the spaces through the central token movement area between pairs of start and finish areas;

(c) random numerical selection apparatus for determining the distance of movement of a player's tokens on the board for each player's turn during play;

(d) game reward units associated with predetermined spaces in the central token movement area; and (e) chance taking apparatus associated with predetermined other spaces located anywhere in the central token movement area of the board, for determining the movement of the tokens of the players or the disposition of game reward units.

2. A game board apparatus according to claim 1 wherein the game reward units are different groups of distinctive units, each group associated with one or more of said associated predetermined spaces on the central token movement area.

3. A game board apparatus according to claim 1 wherein the random numerical selection apparatus comprises a die.

4. A game board apparatus according to claim 1 wherein the random numerical selection apparatus comprises a plurality of cards, each card representing a numerical value.

5. A game board apparatus according to claim 1 wherein the random numerical selection apparatus comprises a spinner device having a pointer rotatable over a disc with segments numerically marked, to point to one of such segments when rotated by a player.

6. A game board apparatus according to claim 1 wherein the random numerical selection apparatus comprises a plurality of cards, each card representing a numerical value, at least some of which cards are associated with questions, the correct answer to which question must be given by a player drawing such a card to permit use of that card for movement of a token of that player.

7. A game board apparatus according to claim 1 wherein the chance taking apparatus comprises a plurality of cards dictating movement of a token or tokens of the player drawing that card or of the tokens of other players, or disposition of game reward units.

8. A game board apparatus according to claim 1, characterized in that the chance taking apparatus comprises a plurality of cards dictating movement of a token or tokens, or the disposition of game reward units of the player drawing that card or of other players, at least some of which cards are associated with questions, the correct answer to which question must be given by a player drawing such card to permit the movement of the tokens or the disposition of game reward units dictated by such card.

9. A game board apparatus according to claim 1 wherein obstacle means are provided anywhere in the central token movement area to impede direct movement of tokens through the spaces in that area.

10. A game board apparatus according to claim 1 wherein the game board has a predetermined number of differently coded, coloured spaces, located in the central token movement area, which spaces are in a predetermined form and shape and are intended to collect game reward units.

11. A game board apparatus according to claim 1 wherein the token finish areas are located either on the periphery of or anywhere inside the central token movement area.

12. A game board apparatus according to claim 1 wherein some or all of said predetermined spaces in the central token movement area which are associated with the game reward units or the chance taking apparatus are releasably securable to the playing surface at different locations selected by the individual players prior to commencement of play.

13. A game board apparatus according to claim 12 wherein the releasably securable predetermined spaces have a reusable self-adhesive backing.

14. A game board apparatus according to claim 12 wherein the releasably securable predetermined spaces are made of magnetic material or have a magnetic backing, and the game board is made of a magnet-attracting material.

15. A game board apparatus according to claim 14 further provided with obstacle means releasably securable to the playing surface at different locations selected by the individual players prior to commencement of play, the obstacle means to impede direct movement of tokens through spaces in the central token movement area, the releasably securable predetermined spaces and the obstacle means being of magnetic material or having a magnetic backing, and the game board being made of a magnet-attracting material.

16. A game board apparatus according to claim 14 further provided with obstacle means releasably securable to the playing surface at different locations selected by the individual players prior to commencement of play, the obstacle means to impede direct movement of tokens through spaces in the central token movement area, the releasably securable predetermined spaces and the obstacle means having a reusable self-adhesive backing.

* * * * *